US007629970B2

(12) United States Patent
Oura

(10) Patent No.: US 7,629,970 B2
(45) Date of Patent: Dec. 8, 2009

(54) IMAGE PROCESSING CIRCUIT AND IMAGE PROCESSING METHOD

(75) Inventor: Hisaharu Oura, Kumamoto (JP)

(73) Assignee: Mitsubishi Electric Corporation, Tokyo (JP)

( * ) Notice: Subject to any disclaimer, the term of this patent is extended or adjusted under 35 U.S.C. 154(b) by 684 days.

(21) Appl. No.: 11/488,723

(22) Filed: Jul. 19, 2006

(65) Prior Publication Data

US 2007/0024558 A1 Feb. 1, 2007

(30) Foreign Application Priority Data

Jul. 27, 2005 (JP) ..... 2005-216994

(51) Int. Cl.
*G06G 5/00* (2006.01)

(52) U.S. Cl. ..... 345/204; 345/87; 345/210; 345/555; 345/690

(58) Field of Classification Search ..... 345/87, 345/204, 210, 555, 690
See application file for complete search history.

(56) References Cited

U.S. PATENT DOCUMENTS

| | | | | |
|---|---|---|---|---|
| 2002/0175907 | A1 | 11/2002 | Sekiya et al. | |
| 2004/0196274 | A1* | 10/2004 | Song et al. | 345/204 |
| 2005/0237316 | A1* | 10/2005 | Huang et al. | 345/204 |
| 2006/0152501 | A1 | 7/2006 | Furihata et al. | |

FOREIGN PATENT DOCUMENTS

| | | |
|---|---|---|
| EP | 1 465 149 A2 | 10/2004 |
| EP | 1 467 346 A2 | 10/2004 |
| JP | 3511592 | 1/2004 |
| KR | 10-2005-0024071 | 3/2005 |

* cited by examiner

*Primary Examiner*—Bipin Shalwala
*Assistant Examiner*—Vince E Kovalick
(74) *Attorney, Agent, or Firm*—Oblon, Spivak, McClelland, Maier & Neustadt, L.L.P.

(57) ABSTRACT

The present invention provides an image processing circuit capable of performing overdrive processing on all gray-scale while suppressing the degradation of the contrast of a liquid crystal display. According to the present invention, an image processing circuit for a liquid crystal display performing overdrive processing includes a data compression circuit for compressing the gray-scale of image data in the direction of medium gray-scale with a predetermined data compression ratio and outputting compressed data, an FRC processing circuit for performing pseudo-gray-scale processing on the compressed data and outputting pseudo-gray-scale image data having the same number of gray-scale as the number of gray-scale of the image data and an overdrive processing circuit for setting the voltage difference between the highest gray-scale and the lowest gray-scale of the pseudo-gray-scale image data to be greater than the voltage difference between the highest gray-scale and the lowest gray-scale of the compressed data, assigning a new voltage in the region of the gray-scale difference between the image data and the compressed data and utilizing the new voltage for overdriving processing.

9 Claims, 4 Drawing Sheets

IMAGE PROCESSING CIRCUIT AND IMAGE PROCESSING METHOD

BACKGROUND OF THE INVENTION

1. Field of the Invention

The present invention relates to an image processing circuit and an image processing method and, more particularly, to an image processing circuit and an image processing method for use in a liquid crystal display.

2. Description of the Background Art

In recent years, liquid crystal displays have been utilized in various fields and have been utilized in televisions as well as in PC monitors. However, liquid crystal displays have low response speeds, thereby including the problem of degradation of display quality due to afterimages in cases where moving images are mainly displayed thereon as in TV applications. Therefore, overdrive processing methods have been applied to liquid crystal displays, in order to increase their response speeds. Overdrive processing is a processing method for, in cases where image data is moving images, setting the voltage applied to the liquid crystal to be higher than usual if the direction of data change from the previous frame to the current frame is positive, but setting the voltage to be lower than usual if the direction of data change from the previous frame to the current frame is negative. This method can improve the display quality of moving images.

As described above, overdrive processing is a method of applying, to the liquid crystal, a higher voltage or a lower voltage than a voltage which is usually applied thereto. Since a highest gray-scale or a lowest gray-scale is generally set for white image data and black image data, it has been impossible to apply, to the liquid crystal, voltages higher or lower than the voltage of the highest gray-scale or lowest gray-scale. Namely, conventional overdrive processing has had the problem that it can be applied to medium-gray-scale image data, but can not be applied to white and black image data.

In the case of a normally-white type liquid crystal display, the voltage to be applied to the liquid crystal for white display (hereinafter, simply referred to as a white voltage) is set to be a lowest value, while the voltage to be applied to the liquid crystal for black display (hereinafter, simply referred to as a black voltage) is set to be a highest value. On the other hand, in the case of a normally-black type liquid crystal display, the voltage to be applied to the liquid crystal for black display is set to be a lowest value, while the voltage to be applied to the liquid crystal for white display is set to be a highest value. In any of the cases of a normally-black type and a normally-white type, it has been impossible to perform overdrive processing for white and black image data.

Therefore, there has been suggested a method for compressing the gray-scale of image data in the direction of medium gray-scale, as described in Japanese Patent No. 3511592, as a method for performing overdrive processing on white and black image data. This method is a method of compressing the gray-scale of image data in the direction of medium gray-scale, in order to save gray-scale usable for overdrive processing above and below the white and black gray-scale. This enables applying a higher voltage or a lower voltage than the black voltage or white voltage after compression.

However, the method of compressing the gray-scale of image data in the direction of medium gray-scale reduces the number of displayable gray-scale and also reduces the voltage difference between the highest gray-scale and the lowest gray-scale of compressed image data. The contrast of a liquid crystal display is determined by the difference between the voltage to be applied for the highest gray-scale and the voltage to be applied for the lowest gray-scale, namely the voltage difference between the highest gray-scale and the lowest gray-scale of image data. Therefore, if the voltage difference is made larger, this will increase the contrast of the liquid crystal display, while if the voltage difference is made smaller, this will reduce the contrast of the liquid crystal display.

The method of compressing the gray-scale of image data in the direction of medium gray-scale had the problem of reduction of the contrast of the liquid crystal display, due to the reduction of the voltage difference between the highest gray-scale and the lowest gray-scale of compressed image data.

SUMMARY OF THE INVENTION

It is an object of the present invention to provide an image processing circuit and an image processing method, each capable of performing overdrive processing on all gray-scale while suppressing the degradation of the contrast of a liquid crystal display.

The present invention provides an image processing circuit for a liquid crystal display performing overdrive processing, and the image processing circuit includes a data compressor, a pseudo-gray-scale processor and an overdrive processor. The data compressor compresses the gray-scale of image data in the direction of medium gray-scale with a predetermined data compression ratio and outputs compressed data. The pseudo-gray-scale processor performs pseudo-gray-scale processing on the compressed data and outputs pseudo-gray-scale image data having the same number of gray-scale as the number of gray-scale of the image data. The overdrive processor sets the voltage difference between the highest gray-scale and the lowest gray-scale of the pseudo-gray-scale image data to be greater than the voltage difference between the highest gray-scale and the lowest gray-scale of the compressed data, assigns a new voltage in the region of the gray-scale difference between the image data and the compressed data and utilizes the new voltage for overdriving processing.

The image processing circuit according to the present invention causes the voltage difference between the highest gray-scale and the lowest gray-scale of pseudo-gray-scale image data to be greater than the voltage difference between the highest gray-scale and the lowest gray-scale of compressed data, assigns a new voltage in the region of the gray-scale difference between the image data and the compressed data and utilizes the new voltage for overdrive processing, thereby producing the effect of performing overdrive processing on all gray-scale while suppressing the degradation of the contrast of the liquid crystal display.

These and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
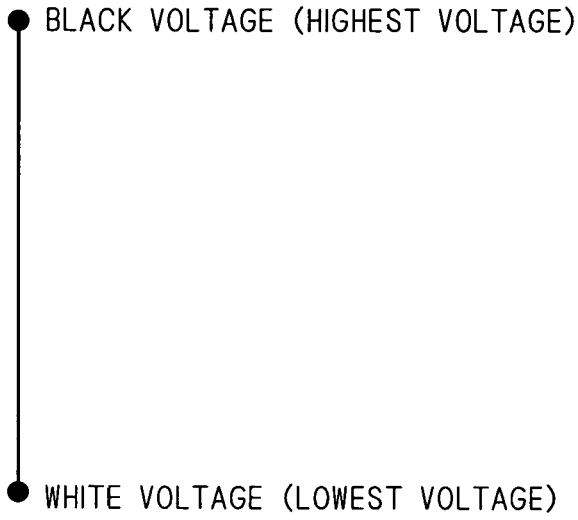
FIG. 1 is a view for explaining the voltage setting for normally-white type.

A liquid crystal display is a display which displays images thereon by being supplied, at its liquid crystal, with a voltage for controlling the arrangement of the liquid crystal molecules for controlling the light transmitted therethrough or reflected thereby. Further, liquid crystal displays are divided into two types, which are normally-white and normally-black types. In the case of a normally-white type liquid crystal display, as illustrated in FIG. 1, the lowest voltage is set to be a voltage to be applied to the liquid crystal at the white-display state (hereinafter, simply referred to as a white voltage), while the highest voltage is set to a voltage to be applied to the liquid crystal at the black-display state (hereinafter, simply referred to as a black voltage). Namely, a normally-white type liquid crystal display is at a white-display state when it is supplied with no voltage.

On the other hand, although not illustrated, in the case of a normally-black type liquid crystal display, the lowest voltage is set to a black voltage while the highest voltage is set to a white voltage. Namely, a normally-black type liquid crystal display is at a black-display state when it is supplied with no voltage.

Figure 2:
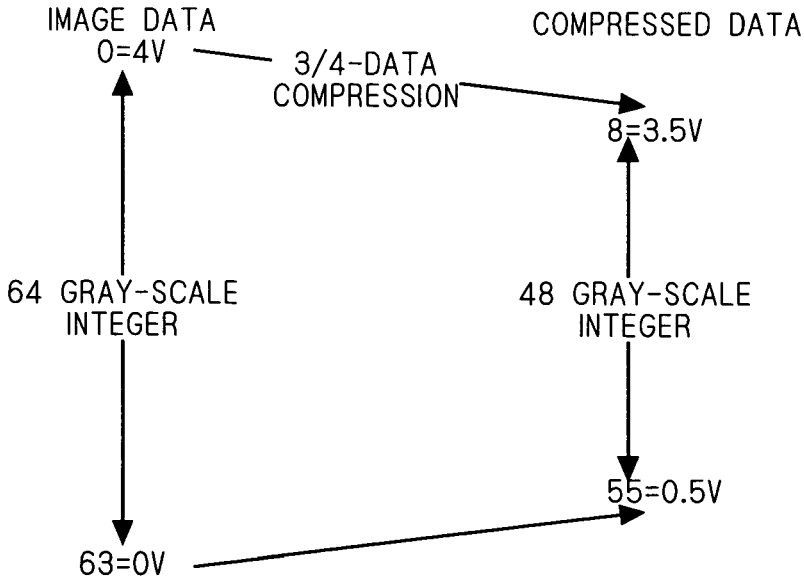
FIG. 2 is a view for explaining a data compression method.

FIG. 2 illustrates an example of overdrive processing described in Description of the Background Art. In FIG. 2, image data is compressed in the direction of medium gray-scale and, based on the compressed data, overdriving processing is performed. More specifically, image data having 64 gray-scale from a 0-th gray-scale (=4V) to a 63-th gray-scale (=0V) is compressed into compressed data having 48 gray-scale from a 8-th gray-scale (=3.5 V) to a 55-th gray-scale (=0.5 V). Namely, in the case of the normally-white liquid crystal display, the black voltage is changed from the 0-th gray-scale (=4 V) to the 8-th gray-scale (=3.5 V) while the white voltage is changed from the 63-th gray-scale (=0 V) to the 55-th gray-scale (=0.5 V). Although compressed data corresponding to the 8-th gray-scale to the 55-th gray-scale of the image data may be expressed as compressed data having 0-th to 48-th gray-scale, the compressed data will be expressed by using the gray-scale of the image data in the present embodiment.

By compressing image data as in FIG. 2, it is possible to save the voltage region (0-th to 7-th gray-scale) higher than the black voltage (8-th gray-scale=3.5 V) and the voltage region (56-th to 63-th gray-scale) lower than the white voltage (55-th gray-scale=0.5 V). Thus, the saved gray-scale (the 0-th to 7-th gray-scale and the 56-th to 63-th gray-scale) can be utilized for performing overdrive processing for the white voltage and the black voltage.

However, if image data is compressed as in FIG. 2, this will reduce the number of gray-scale and also reduce the potential difference between the black voltage and the white voltage. If the potential difference between the black voltage and the white voltage is reduced, this will degrade the contrast of the liquid crystal display as previously described.

Figure 3:
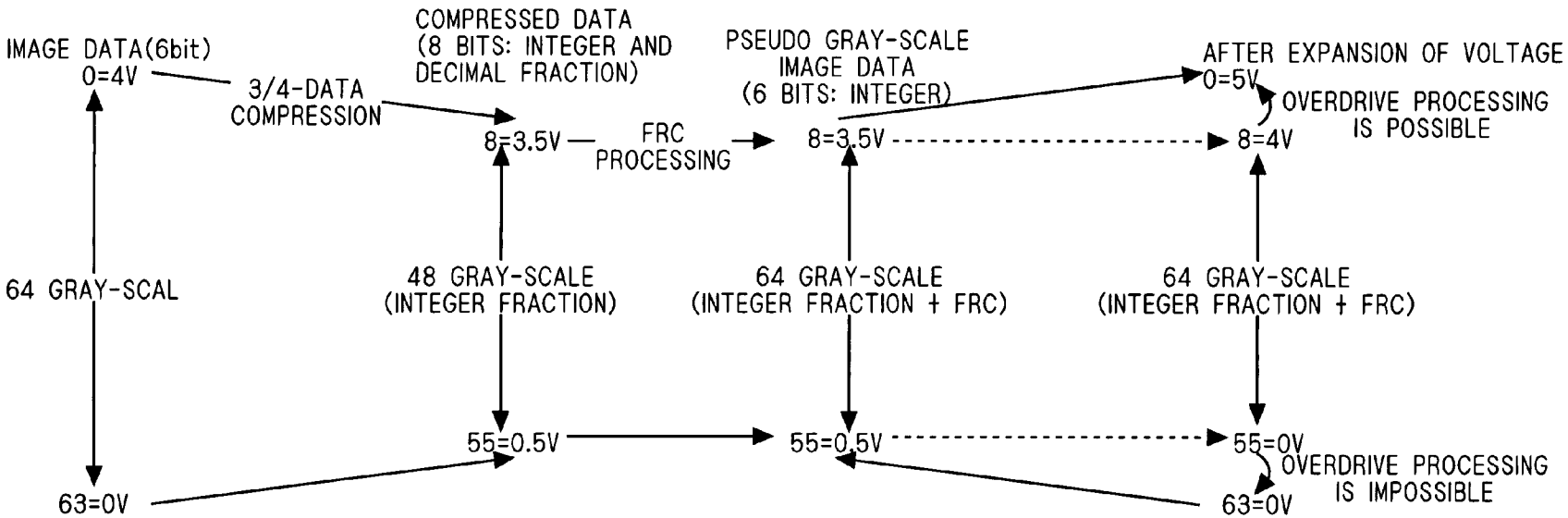
FIG. 3 is a view for explaining an image processing method according to a first embodiment of the present invention.
Figure 4:
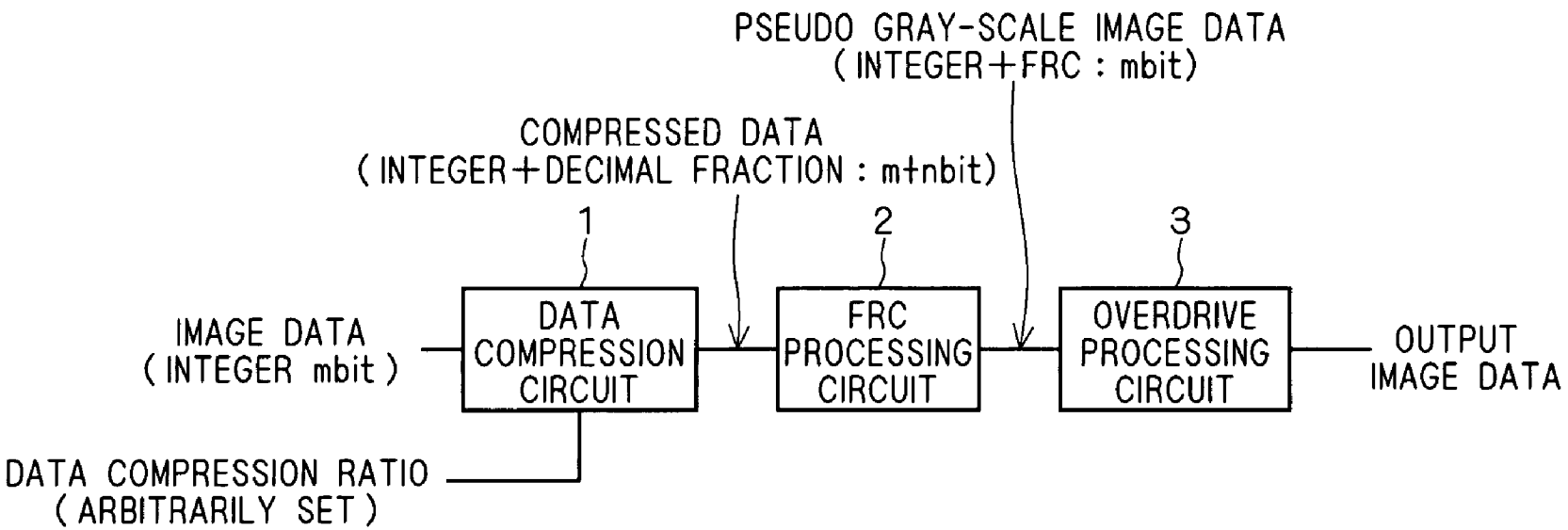
FIG. 4 is a block diagram illustrating an image processing circuit according to the first embodiment of the present invention.

Therefore, in the present embodiment, an image processing method illustrated in FIG. 3 is employed, which enables performing overdrive processing for all gray-scale including the white gray-scale and the black gray-scale, while suppressing the reduction of the number of gray-scale and the contrast. FIG. 3 illustrates a case where the liquid crystal display is of a normally-white type. FIG. 4 illustrates a block diagram of an image processing circuit which performs the image processing method illustrated in FIG. 3.

In the image processing method illustrated in FIG. 3, at first, 6-bit image data is compressed in the direction of medium gray-scaleimilarly. In this case, the image data has 64 gray-scale from a 0-th gray-scale (=4 V) to a 63-th gray-scale (=0V). If the image data is subjected to ¾-data compression in the direction of medium gray-scale, more specifically, image data of the 0-th gray-scale, image data of a 1st gray-scale, image data of a 2nd gray-scale, and image data of a 3rd gray-scale are compressed into compressed data of a 8-th gray-scale, compressed data of a 8.75-th gray-scale, compressed data of a 9.5-th gray-scale and compressed data of a 10.25-th gray-scale, respectively. The other gray-scale higher than them are similarly compressed and, thus, image data of the 63-th gray-scale is compressed into compressed data of a 55.25-th gray-scale.

However, since the number of gray-scale of compressed data should be an integer, the decimal fraction thereof has been conventionally discarded so that image data of the 0-th and the 1st gray-scale, image data of the 2nd gray-scale and image data of the 3rd gray-scale have been compressed into compressed data of the 8-th gray-scale, compressed data of the 9-th gray-scale and compressed data of the 10-th gray-scale, respectively. Consequently, image data having the 0-th to 3rd gray-scale (four gray-scale) has been ¾-data-compressed into compressed data having the 8-th to 10-th gray-scale (3 gray-scale).

On the other hand, in the present embodiment, compressed data is made to be 8-bit data having an integer fraction and a decimal fraction, without discarding the decimal fraction thereof. Therefore, in the present embodiment, the decimal fraction of compressed data can be utilized for performing pseudo-gray-scale processing. In FIG. 3, FRC (Frame Rate Control) processing is employed as pseudo-gray-scale processing. In this case, the FRC processing is a processing method for expressing gray-scale in a pseudo manner by varying the ratio between the to-be-displayed frames and the to-be-undisplayed frames, out of plural frames.

For example, in the case of compressed data of the 8-th gray-scale having no decimal fraction, the FRC processing illustrated in FIG. 3 causes the 8-th gray-scale to be displayed in all the frames, while in the case of compressed data of the 8.75-th gray-scale, the FRC processing causes the 9-th gray-scale to be displayed in three of every four frames. Further, for example, in the case of compressed data of the 9.5-th gray-scale, the FRC processing illustrated in FIG. 3 causes the 10-th gray-scale to be displayed in two of every four frames, while in the case of compressed data of the 10.25-th gray-scale the FRC processing causes the 11-th gray-scale to be displayed in one of every four frames. By performing the aforementioned FRC processing on compressed data, it is possible to convert compressed data having 48 gray-scale into pseudo-gray-scale image data having 64 gray-scale.

The pseudo-gray-scale image data is expressed as 6-bit data consisting of only an integer fraction. While the pseudo-gray-scale image data may be newly expressed as having 0-th to 63-th gray-scale, the gray-scale of the pseudo-gray-scale image data are expressed by the gray-scale of the image data in the case illustrated in FIG. 3.

While the pseudo-gray-scale processing illustrated in FIG. 3 is FRC processing, the present invention is not limited thereto and may employ other pseudo-gray-scale processing such as dither processing. While only FRC processing is employed as pseudo-gray-scale processing as in the present embodiment, the present invention may employ a combination of FRC processing and dither processing as pseudo-gray-scale processing.

In the case where compressed data has a decimal fraction of 0.25, the aforementioned pseudo-gray-scale processing causes one of every four frames to be displayed. In the case where compressed data has a decimal fraction of 0.5, the pseudo-gray-scale processing causes two of every four frames to be displayed. In the case where compressed data has a decimal fraction of 0.75, the pseudo-gray-scale processing causes three of every four frames to be displayed. The present invention is not limited thereto and may employ any other processing methods capable of controlling pseudo-gray-scale processing based on the decimal fraction of compressed data.

The pseudo-gray-scale image data illustrated in FIG. 3 has 64 gray-scaleimilarly to image data, as a result of the pseudo-gray-scale processing. Accordingly, the pseudo-gray-scale image has an increased number of gray-scale. However, the black voltage of the pseudo-gray-scale image data is maintained at the 8-th gray-scale (=3.5 V) and the white voltage thereof is also maintained at the 55-th gray-scale (=0.5 V), since it takes over from the compressed data. Accordingly, if the liquid crystal display is driven based on the pseudo-gray-scale image data, the contrast will be still degraded.

Therefore, according to the present embodiment, the voltage difference between the highest gray-scale (the 8-th gray-scale) and the lowest gray-scale (the 55-th gray-scale) of the pseudo-gray-scale image data illustrated in FIG. 3 is reset to be of the same magnitude as that of the voltage difference between the highest gray-scale (the 0-th gray-scale) and the lowest gray-scale (the 63-th gray-scale) of the image data. Namely, the black voltage (the 8-th gray-scale) of the pseudo-gray-scale image data is expanded from 3.5 V to 4 V and the white voltage (the 55-th gray-scale) of the pseudo-gray-scale image data is expanded from 0.5 V to 0 V.

Accordingly, with the present embodiment, it is possible to improve the contrast of the liquid crystal display which is determined by the difference between the black voltage and the white voltage, thereby enabling displaying images with higher display quality. Further, with the present embodiment, it is possible to set new voltages in the region of the gray-scale difference between the image data and the compressed data (the region (0-th to 7-th gray-scale) higher than the black voltage (8-th gray-scale) and the region (56-th to 63-th gray-scale) lower than the white voltage (55-th gray-scale)). More specifically, the 0-th gray-scale is set at 5 V. Further, as can be seen from FIG. 3, it is not possible to set a voltage to be equal to or lower than the white voltage (55-th gray-scale)=0 V, which makes it impossible to set a voltage equal to or lower than 0 V in the region of 56-th to 63-th gray-scale.

In the present embodiment, it is possible to set a higher voltage (0-th gray-scale=5 V) than the black voltage (8-th gray-scale), which enables performing overdrive processing for the black voltage. However, it is not possible to perform overdrive processing for the white voltage, since a voltage equal to or lower than 0 V can not be set.

In the case of a normally-black type liquid crystal display, there is a relationship opposite to that described above, and it is possible to set a higher voltage (0-th gray-scale=5V) than the white voltage (8th-gray-scale), which enables performing overdrive processing for the white voltage, while overdrive processing can not be performed for the black voltage since voltages equal to or lower than 0 V can not be set.

Further, in FIG. 3, the voltage difference between the highest gray-scale (8-th gray-scale) and the lowest gray-scale (55-th gray-scale) of the pseudo-gray-scale image data is reset to be of the same magnitude as that of the voltage difference between the highest gray-scale (0-th gray-scale) and the lowest gray-scale (63-th gray-scale) of the image data. This is processing for ensuring the same contrast as that of the image data. Therefore, by sacrificing the constant to some degrees, it becomes possible to perform overdrive processing for both the black voltage and the white voltage.

Namely, the voltage difference between the highest gray-scale (8-th gray-scale) and the lowest gray-scale (55-th gray-scale) of the pseudo-gray-scale image data can be set to be smaller than the voltage difference between the highest gray-scale (0-th gray-scale) and the lowest gray-scale (63-th gray-scale) of the image data, but greater than the voltage difference between the highest gray-scale (8-th gray-scale) and the lowest gray-scale (55-th gray-scale) of the compressed data. More specifically, the highest gray-scale (8-th gray-scale) of the pseudo-gray-scale image data can be set at 4 V and the lowest gray-scale (55-th gray-scale) thereof can be set at 0.25 V. This enables setting a higher voltage (0-th gray-scale=5V) than the white voltage (8-th gray-scale) and setting a lower voltage (63-th gray-scale=0V) than the black voltage (55-th gray-scale).

Hereinafter, the image processing method illustrated in FIG. 3 will be described, with reference to a block diagram of FIG. 4. First, m-bit image data is input to a data compression circuit 1 which is a data compressor. The image data includes only an integer fraction. Further, a data compression ratio is supplied to the data compression circuit 1. While, in the case of FIG. 3, the data compression ratio is ¾, the present invention is not limited thereto and the data compression ratio can be set to an arbitrary value (for example, 5/16, ½ or the like). Since the data compression ration can be arbitrarily set in the present invention, it is possible to perform optimal overdrive processing under various conditions.

The data compression circuit 1 compresses the image data in the direction of medium gray-scale based on the data compression ratio and outputs the compressed data. The compressed data contains m bits in its integer fraction and also contains n bits in its decimal fraction. Next, the compressed data is input to an FRC processing circuit 2 which is a pseudo-gray-scale processor. The FRC processing circuit 2 performs FRC processing based on the decimal fraction of the compressed data and outputs pseudo-gray-scale image data having the same number of gray-scale as that of the image data. The pseudo-gray-scale image data contains m bits in its integer fraction.

Next, the pseudo-gray-scale image data is input to an overdrive processing circuit 3 which is an overdrive processor. The overdrive processing circuit 3 sets the voltage difference between the highest gray-scale and the lowest gray-scale of the pseudo-gray-scale image data to be greater than the voltage difference between the highest gray-scale and the lowest gray-scale of the compressed data and also assigns a new voltage in the region of the gray-scale difference between the image data and the compressed data (0-th to 7-th gray-scale and 56-th to 63-th gray-scale). Consequently, the overdrive processing circuit 3 can perform overdrive processing for the highest gray-scale (the black voltage in the case of a normally-white type) or the lowest gray-scale (the white voltage, in the case of a normally-white type) of the pseudo-gray-scale image data, by utilizing the newly assigned voltage. Further, the overdrive processing for other gray-scale is performed in a conventional manner and therefore detailed description thereof is omitted.

The overdrive processing circuit 3 performs overdrive processing on the pseudo-gray-scale image data and outputs output image data to be finally applied to the liquid crystal. Further, the overdrive processing is applied only when the image data of the current frame is a moving image and, therefore, the image processing circuit according to the present embodiment includes a moving-image/static-image determination circuit, although not illustrated in FIG. 4.

As described above, the image processing circuit and the image processing method according to the present embodiment set the voltage difference between the highest gray-scale and the lowest gray-scale of pseudo-gray-scale image data to be greater than the voltage difference between the highest gray-scale and the lowest gray-scale of compressed data and also assign a new voltage in the region of the gray-scale difference between the image data and the compressed data for utilizing the new voltage for overdrive processing, which enables overdrive processing for all gray-scale while suppressing the degradation of the contrast of the liquid crystal display.

Also, the image processing circuit according to the present embodiment may be formed from either hardware or software.

Second Embodiment

Figure 5:
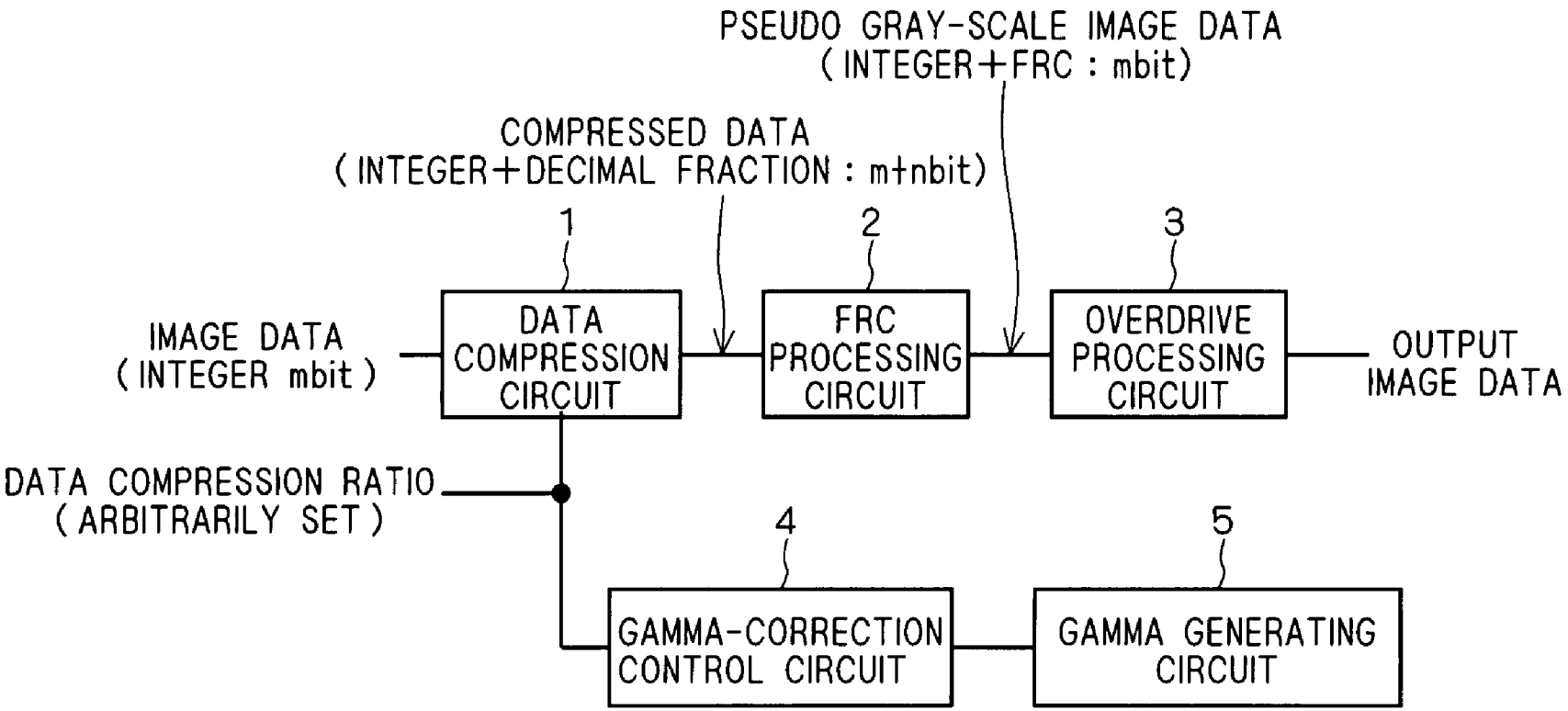
FIG. 5 is a block diagram illustrating an image processing circuit according to a second embodiment of the present invention.

FIG. 5 illustrates a block diagram of an image processing circuit according to the present embodiment. The image processing circuit illustrated in FIG. 5 is structured by adding, to the image processing circuit illustrated in FIG. 4, a gamma-correction control circuit 4 which is a gamma-correction controller and a gamma generating circuit 5 which is a gamma generator.

The display brightness (luminosity) of a liquid crystal display is increased with increasing voltage applied thereto, along a curve, not proportionally. A method for correcting the relationship between the applied voltage and the display brightness is gamma correction. However, if image data is compressed as described in the first embodiment, the data compression ratio thereof will affect the gamma correction.

Therefore, in the image processing circuit according to the present embodiment, there is provided the gamma-correction control circuit 4 for controlling the gamma generating circuit 5 which performs gamma correction, in consideration of the influences of the data compression ratio. Accordingly, the image processing circuit according to the present embodiment can perform optimal gamma correction, regardless of the change of the data compression ratio.

Also, the image processing circuit according to the present embodiment may be formed from either hardware or software.

While the invention has been shown and described in detail, the foregoing description is in all aspects illustrative and not restrictive. It is therefore understood that numerous modifications and variations can be devised without departing from the scope of the invention.

What is claimed is:

1. An image processing circuit for a liquid crystal display performing overdrive processing, the image processing circuit comprising:

a data compressor for compressing the gray-scale of image data in the direction of medium gray-scale with a predetermined data compression ratio and outputting compressed data;

a pseudo-gray-scale processor for performing pseudo-gray-scale processing on said compressed data and outputting pseudo-gray-scale image data having the same number of gray-scale as the number of gray-scale of said image data; and an overdrive processor for setting the voltage difference between the highest gray-scale and the lowest gray-scale of said pseudo-gray-scale image data to be greater than the voltage difference between the highest gray-scale and the lowest gray-scale of said compressed data, assigning a new voltage in the region of the gray-scale difference between said image data and said compressed data and utilizing the new voltage for overdriving processing.

2. The image processing circuit according to claim 1, wherein said overdrive processor sets the voltage difference between the highest gray-scale and the lowest gray-scale of said pseudo-gray-scale image data to be of the same magnitude as that of the voltage difference between the highest gray-scale and the lowest gray-scale of said image data.

3. The image processing circuit according to claim 2, wherein said data compressor arbitrarily sets said data compression ratio.

4. The image processing circuit according to claim 2, wherein said data compressor stores, in said compressed data, data of the decimal fraction resulted from the compression of the gray-scale of said image data, and said pseudo-gray-scale processor performs frame rate control processing based on said data of the decimal fraction.

5. The image processing circuit according to claim 2, further comprising:

a gamma generator for performing gamma correction; and a gamma-correction controller for controlling said gamma generator, based on said data compression ratio.

6. The image processing circuit according to claim 1, wherein said data compressor arbitrarily sets said data compression ratio.

7. The image processing circuit according to claim 1, wherein said data compressor stores, in said compressed data, data of the decimal fraction resulted from the compression of the gray-scale of said image data, and said pseudo-gray-scale processor performs frame rate control processing based on said data of the decimal fraction.

8. The image processing circuit according to claim 1, further comprising:

a gamma generator for performing gamma correction; and a gamma-correction controller for controlling said gamma generator, based on said data compression ratio.

9. An image processing method comprising:

a data compression step of compressing the gray-scale of image data in the direction of medium gray-scale with a predetermined data compression ratio and outputting compressed data;

a pseudo-gray-scale processing step of performing pseudo-gray-scale processing on said compressed data and outputting pseudo-gray-scale image data having the same number of gray-scale as the number of gray-scale of said image data; and an overdrive processing step of setting the voltage difference between the highest gray-scale and the lowest gray-scale of said pseudo-gray-scale image data to be greater than the voltage difference between the highest gray-scale and the lowest gray-scale of said compressed data, assigning a new voltage in the region of the gray-scale difference between said image data and said compressed data and utilizing the new voltage for overdriving processing.

* * * * *